US009453387B2

(12) United States Patent
Andersen

(10) Patent No.: US 9,453,387 B2
(45) Date of Patent: Sep. 27, 2016

(54) SWELLABLE PACKER HAVING REINFORCEMENT PLATE

(71) Applicant: HALLIBURTON ENERGY SERVICES, INC., Houston, TX (US)

(72) Inventor: Kristian Andersen, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/402,139

(22) PCT Filed: Sep. 21, 2012

(86) PCT No.: PCT/US2012/056678

§ 371 (c)(1),
(2) Date: Nov. 19, 2014

(87) PCT Pub. No.: WO2014/046676

PCT Pub. Date: Mar. 27, 2014

(65) Prior Publication Data

US 2015/0260006 A1 Sep. 17, 2015

(51) Int. Cl.
*E21B 33/12* (2006.01)

(52) U.S. Cl.
CPC ..... *E21B 33/1208* (2013.01); *E21B 33/1216* (2013.01); *Y10T 29/49826* (2015.01)

(58) Field of Classification Search
CPC .. E21B 33/127; E21B 33/1277; E21B 33/12; E21B 33/1208; Y10T 29/49826
See application file for complete search history.

(56) References Cited

U.S. PATENT DOCUMENTS 2,184,634 A 12/1939 Crickmer et al.
2,797,759 A 7/1957 Long et al.
7,023,212 B2 4/2006 Chen et al.
7,849,930 B2 * 12/2010 Chalker ..... E21B 33/1208 166/387
7,874,354 B2 1/2011 Freyer
8,051,914 B2 11/2011 Freyer
2007/0151724 A1 7/2007 Ohmer et al.
2007/0235182 A1 10/2007 Artherholt
2008/0185158 A1 8/2008 Chalker et al.
2009/0179383 A1 7/2009 Koloy et al.
2009/0242189 A1 10/2009 Vaidya et al.
2009/0255690 A1 10/2009 Conner et al.
2010/0116496 A1 5/2010 Allen et al.
2010/0243235 A1 9/2010 Caldwell et al.
2011/0147014 A1 6/2011 Chen et al.
2012/0031608 A1 2/2012 Lembcke et al.

OTHER PUBLICATIONS

Search Report and Written Opinion issued Apr. 22, 2013 for International Application PCT/US12/56678, 11 pages.

(Continued)

*Primary Examiner* — Yong-Suk (Philip) Ro
(74) *Attorney, Agent, or Firm* — Locke Lord LLP

(57) ABSTRACT

A packer assembly for use with a subterranean well can include a base pipe, at least one ring-shaped reinforcement plate which encircles the base pipe, and at least one swellable seal material which longitudinally straddles the reinforcement plate on the base pipe. A method of constructing a packer assembly can include securing at least one ring-shaped reinforcement plate to a base pipe, the plate encircling the base pipe, and then positioning at least one swellable seal material on the base pipe, the swellable seal material straddling the reinforcement plate. Another method of constructing a packer assembly can include securing at least one ring-shaped reinforcement plate to at least one swellable seal material, and then positioning the plate and the swellable seal material on a base pipe.

1 Claim, 3 Drawing Sheets

(56) References Cited

OTHER PUBLICATIONS

E. R. Bridgewater, "Physical Properties of DuPrene Compounds", Am. Chem. Soc. Chem. Rev., J. Am. Chem. Soc., Jan. 31, 1934, pp. 33-36.

Extended European Search Report dated Feb. 3, 2016, issued during the prosecution of European Patent Application No. 12885091.4 (8 pages).

Canadian Office Action dated Dec. 17, 2015, issued during the prosecution of Canadian Patent Application No. 2,875,943, (3 pages).

* cited by examiner

SWELLABLE PACKER HAVING REINFORCEMENT PLATE

CROSS-REFERENCE TO RELATED APPLICATION

This application is a national stage under 35 USC 371 of International Application No. PCT/US12/56678, filed on 21 Sep. 2012. The entire disclosure of this prior application is incorporated herein by this reference.

TECHNICAL FIELD

This disclosure relates generally to equipment used and operations performed in conjunction with a subterranean well and, in one example described below, more particularly provides a swellable packer having one or more reinforcement plates therein.

BACKGROUND

A packer is used in a well to seal off an annulus between tubulars, or between a wellbore and a tubular. Typically, a swellable packer swells in response to contact with a particular activating agent in the well. It will be appreciated that improvements are continually needed in the arts of constructing and utilizing swellable packers.

SUMMARY

In this disclosure, a swellable packer is provided which brings improvements to the art. One example is described below in which a ring-shaped plate is embedded in a swellable seal material and placed on a base pipe, thereby increasing a differential pressure holding capability of the packer. Another example is described below in which the ring-shaped plate is secured to the base pipe, and then the swellable seal material is molded onto the base pipe.

A packer assembly for use with a subterranean well is provided to the art by the disclosure below. In one example, the packer assembly can include a base pipe, one or more ring-shaped reinforcement plates which encircle the base pipe, and one or more swellable seal materials which longitudinally straddle the reinforcement plates on the base pipe.

A method of constructing a packer assembly is also described below. In one example, the method can comprise: securing at least one ring-shaped reinforcement plate to a base pipe, the plate encircling the base pipe, and then positioning at least one swellable seal material on the base pipe, the swellable seal material straddling the reinforcement plate.

Another method of constructing a packer assembly described below can include: securing at least one ring-shaped reinforcement plate to at least one swellable seal material, and then positioning the plate and the swellable seal material on a base pipe.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
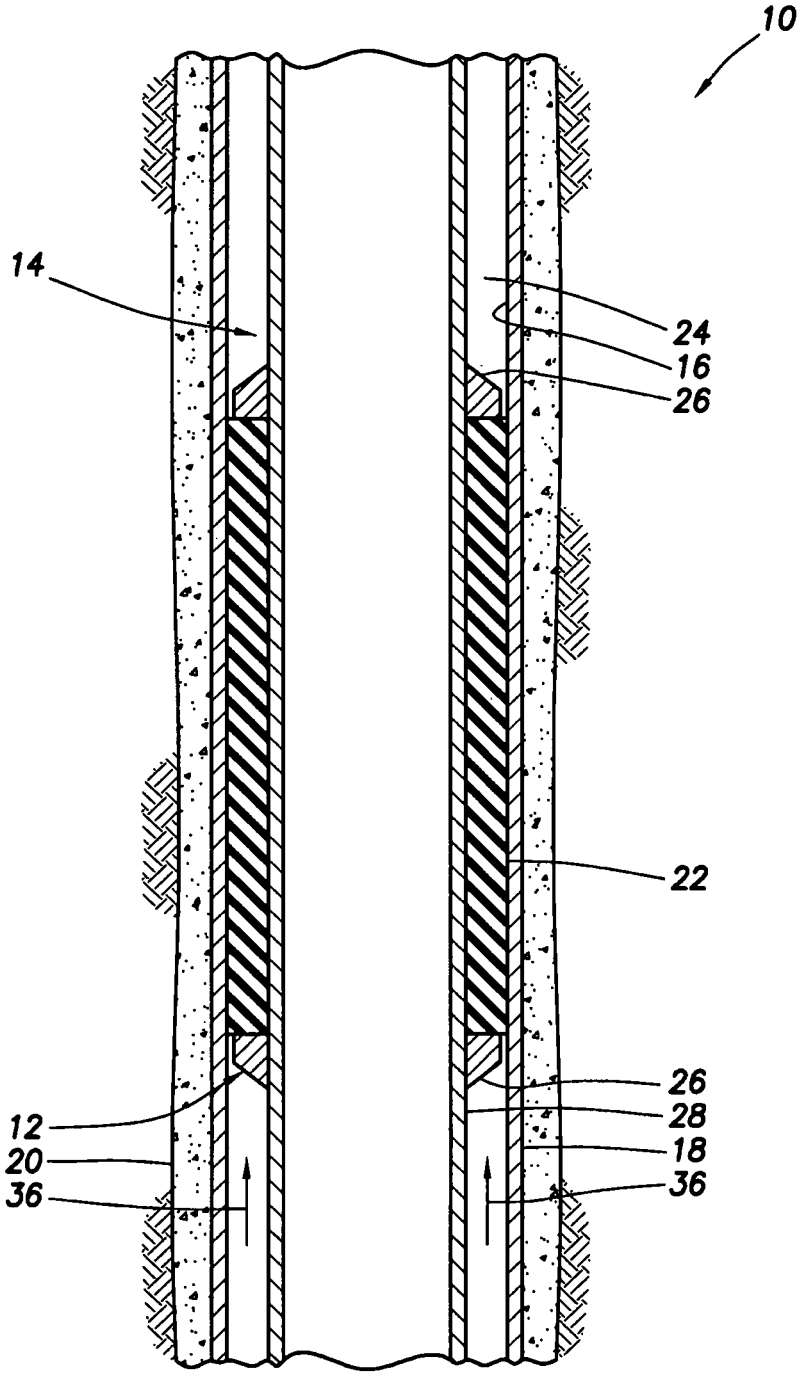
FIG. 1 is a representative partially cross-sectional view of a system for use with a subterranean well, and an associated method, which system and method can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a swellable packer assembly 12 is interconnected as part of a tubular string 14 positioned in a wellbore 16. The wellbore 16 may be lined with casing 18 and cement 20, or in other examples the wellbore may be uncased or open hole.

The packer assembly 12 includes an annular seal element 22 for sealing off an annulus 24 formed radially between the tubular string 14 and the wellbore 16. The seal element 22 seals off the annulus 24 by swelling in response to contact with a particular activating agent (e.g., a particular fluid 36) in the well.

The seal element 22 is longitudinally straddled by end rings 26 secured to a base pipe 28. The seal element 22 and end rings 26 may be configured in a variety of different ways. Thus, it should be clearly understood that the scope of this disclosure is not limited to any particular construction or configuration of a packer assembly.

Figure 2:
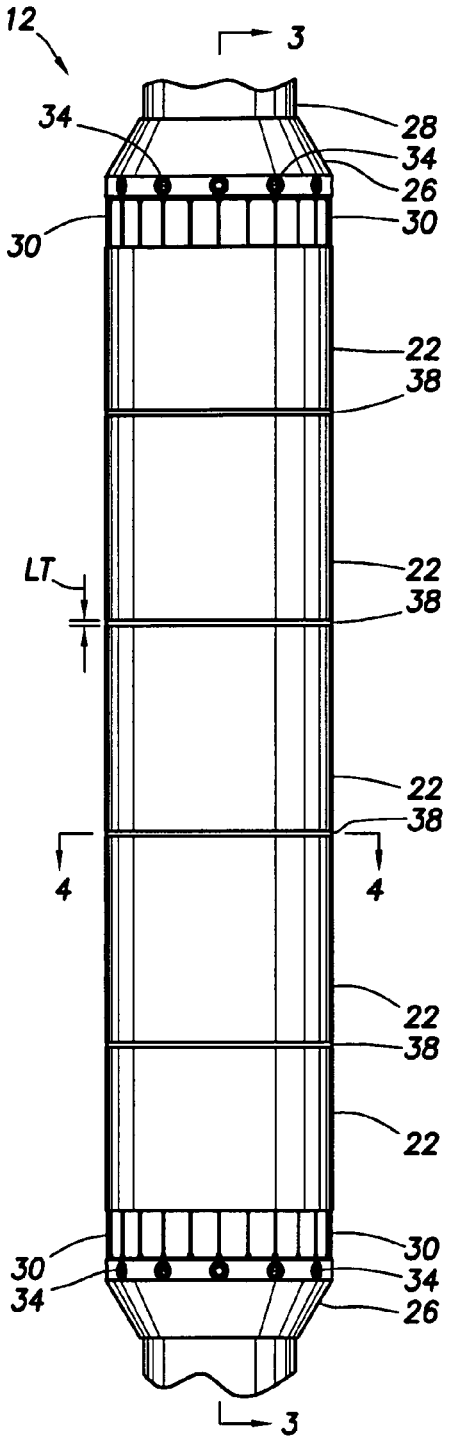
FIG. 2 is an enlarged scale representative elevational view of a packer assembly which can embody principles of this disclosure.

Referring additionally now to FIG. 2, one example of the packer assembly 12 is representatively illustrated in an elevational view. The packer assembly 12 is depicted in a cross-sectional view in FIG. 3. The packer assembly 12 may be used in the system 10 and method of FIG. 1, or the packer assembly can be used in other systems and methods, in keeping with the principles of this disclosure.

Figure 3:
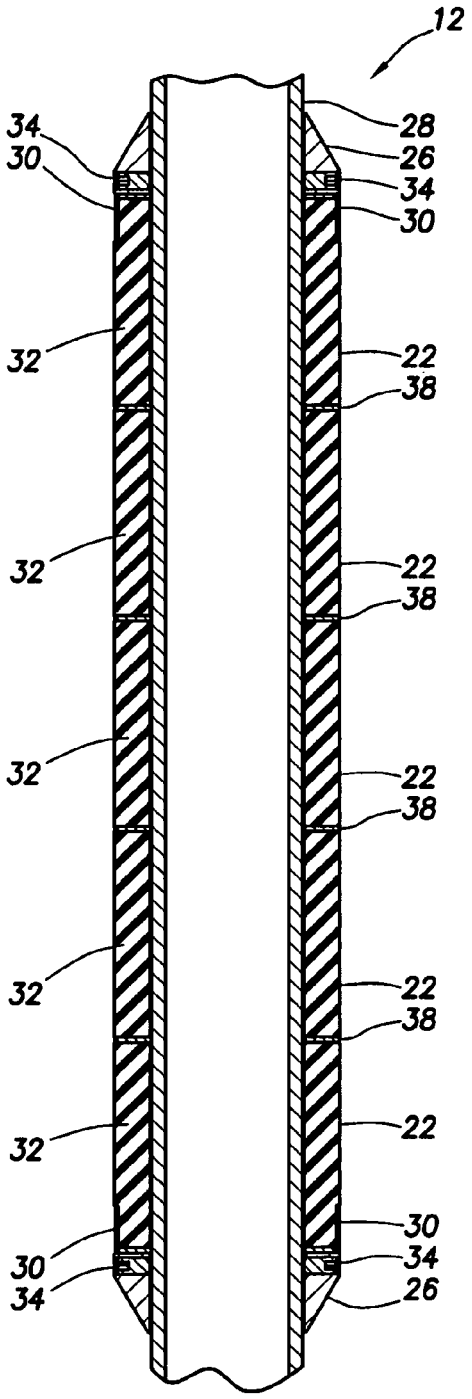
FIG. 3 is a representative cross-sectional view of the packer assembly, taken along line 3-3 of FIG. 2.

In the FIGS. 2 & 3 example, the packer assembly 12 includes multiple annular-shaped swellable seal elements 22 longitudinally distributed on the base pipe 28. The seal elements 22 are retained on the base pipe 28 by the end rings 26, which are secured to the base pipe. "Leaves" 30 overlap outer ends of the outermost seal elements 22, and are deflected outward when the seal elements swell, in order to close off extrusion gaps between the end rings 26 and the wellbore 16.

The seal elements 22 comprise a swellable material 32. All of the seal elements 22 may include the same swellable material 32, or there may be differences in the swellable material for the respective different seal elements.

Preferably, the swellable material 32 swells when it is contacted with a particular activating agent (e.g., oil, gas, other hydrocarbons, water, acid, other chemicals, etc.) in the well. The activating agent may already be present in the well, or it may be introduced after installation of the packer assembly 12 in the well, or it may be carried into the well with the packer assembly, etc. The swellable material 32 could instead swell in response to exposure to a particular temperature, or upon passage of a period of time, or in response to another stimulus, etc.

Thus, it will be appreciated that a wide variety of different ways of swelling the swellable material 32 exist and are known to those skilled in the art. Accordingly, the scope of this disclosure is not limited to any particular manner of swelling the swellable material 32. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 32 is in this example preferably a hydrocarbon fluid (such as oil or gas). In the well system 10, the swellable material 32 swells when a fluid 36 comprises the activating agent (e.g., when the fluid enters the wellbore 16 from a formation surrounding the wellbore, when the fluid is circulated to the packer assembly 12 from the surface, when the fluid is released from a chamber carried with the packer assembly, etc.). In response, the seal element 22 seals off the annulus 24 and applies a gripping force to the wellbore 16.

The activating agent which causes swelling of the swellable material 32 could be comprised in any type of fluid. The activating agent could be naturally present in the well, or it could be conveyed with the packer assembly 12, conveyed separately or flowed into contact with the swellable material 32 in the well when desired. Any manner of contacting the activating agent with the swellable material 32 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 32 may have a substantial portion of cavities therein which are compressed or collapsed at the surface condition. Then, after being placed in the well at a higher pressure, the material 32 is expanded by the cavities filling with fluid.

This type of apparatus and method might be used where it is desired to expand the swellable material 32 in the presence of gas rather than oil or water. A suitable swellable material is described in U.S. Published Application No. 2007-0257405, the entire disclosure of which is incorporated herein by this reference.

Preferably, the swellable material 32 used in the seal element 22 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 32 could also swell in response to contact with any of multiple activating agents. For example, the swellable material 32 could swell when contacted by hydrocarbon fluid, or when contacted by water.

In the FIGS. 2 & 3 example, pairs of the seal elements 22 longitudinally straddle respective ones of ring-shaped reinforcement plates 38. The reinforcement plates 38 are preferably relatively thin, flat and made of a metal material, but other shapes, configurations and/or materials may be used and remain within the scope of this disclosure.

The reinforcement plates 38 increase a differential pressure holding capability of the packer assembly 12 by reducing a tendency of the swellable material 32 to extrude when a large pressure differential is applied across the seal elements 22 in the annulus 24. The reinforcement plates 38 mitigate distortion of the seal elements 22 due to the differential pressure.

Figure 4:
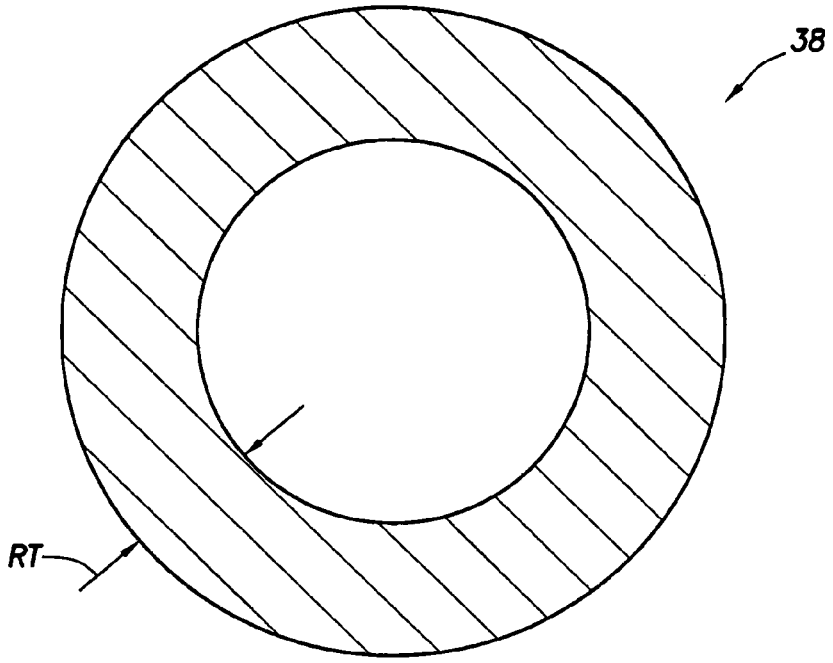
FIG. 4 is representative plan view of a reinforcement plate which may be used in the packer assembly of FIGS. 2 & 3.

Referring additionally now to FIG. 4, an enlarged scale view of one of the reinforcement plates 38 is representatively illustrated. In this view, it may be seen that the reinforcement plate 38 has a radial thickness RT which is substantially greater than its longitudinal thickness LT (see FIG. 3).

An inner diameter of the reinforcement plate 38 is preferably somewhat larger than an outer diameter of the base pipe 28, and an outer diameter of the reinforcement plate is preferably approximately the same as outer diameters of the end rings 26 and seal elements 22. In other examples, the reinforcement plate 38 could be otherwise dimensioned.

In one technique for constructing the packer assembly 12, the reinforcement plates 38 can be longitudinally spaced apart on the base pipe 28. The reinforcement plates 38 can be secured to the base pipe 28 by, for example, welding, fastening, bonding, integrally forming, etc.

After the reinforcement plates 38 are secured to the base pipe 28, the seal material 32 is molded onto the base pipe, thereby forming the seal elements 22. The molding process can include bonding or otherwise adhering the seal material 32 to the base pipe 28 and/or reinforcement plates 38.

Figure 5:
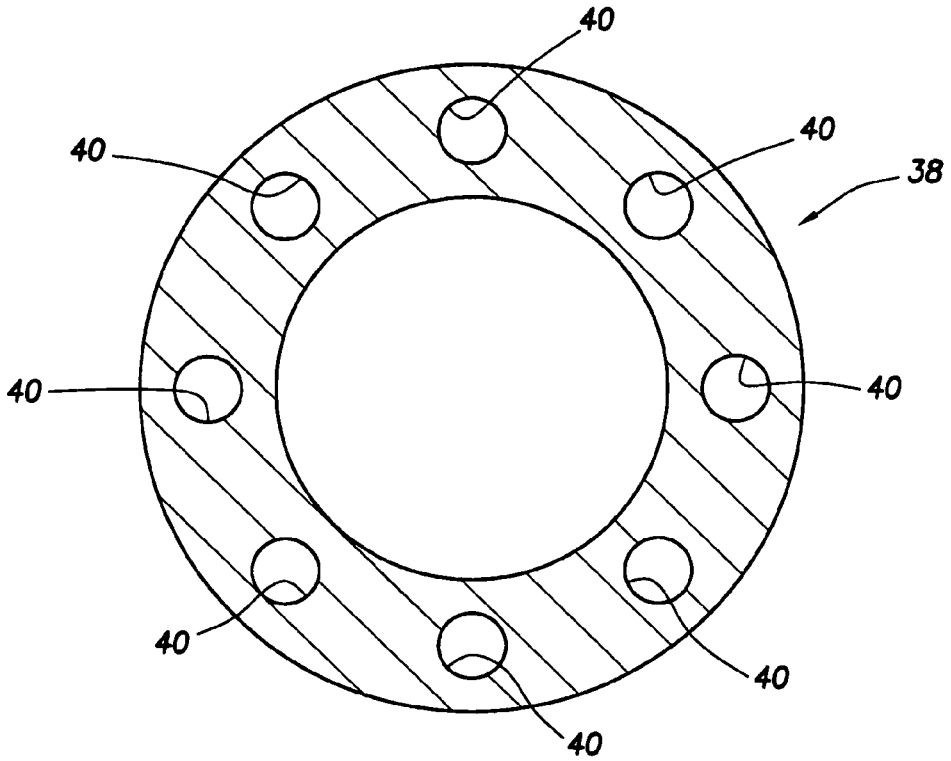
FIG. 5 is a representative plan view of another example of the reinforcement plate.

Referring additionally now to FIG. 5, another example of the reinforcement plate 38 is representatively illustrated. In this example, the reinforcement plate 38 has openings 40 formed longitudinally through it. Any number, shapes, positions, dimensions and/or type of openings 40 may be used, in keeping with the scope of this disclosure.

If the FIG. 5 reinforcement plate 38 is used in the method described above, the swellable material 32 can extrude through the openings 40 during the molding process, so that the swellable material extends from one side to another of the reinforcement plate. One benefit of this construction technique is that the swellable material 32 is secured relative to the reinforcement plates 38.

Other techniques for securing the swellable material 32 to the reinforcement plates 38 include bonding or otherwise adhering the swellable material to the reinforcement plates. However, it is not necessary for the swellable material 32 to be secured relative to the reinforcement plates 38 in keeping with the scope of this disclosure.

In another method of constructing the packer assembly 12, the seal elements 22 and reinforcement plates 38 can be secured to each other before positioning them on the base pipe 28. For example, the seal elements 22 and reinforcement plates 38 could be bonded or otherwise adhered to each other, and then the seal elements/reinforcement plates subassembly could be slid onto the base pipe and secured thereon with the end rings 26 and/or bonded to the base pipe.

In another method, the seal elements 22 could be molded with the reinforcement plates 38 embedded therein, separate from the base pipe 28. Then, the seal elements 22 and reinforcement plates 38 could be slid onto the base pipe 28 and secured thereon with the end rings 26 and/or bonded to the base pipe.

In yet another method, the seal elements 22 could be formed as separate annular-shaped elements (e.g., by molding). Then, the seal elements 22 and reinforcement plates 38 could be adhered to each other, followed by sliding onto the base pipe 28.

In this example, the seal elements 22 could be adhered to each other via the openings 40 in the reinforcement plate 38 of FIG. 5. The seal elements 22/reinforcement plates 38 subassembly could be slid onto the base pipe 28 and secured thereon with the end rings 26 and/or bonded to the base pipe.

Thus, it will be appreciated that a wide variety of different methods may be used for constructing the packer assembly 12. The scope of this disclosure is not limited to any particular method or construction for the packer assembly 12.

It may now be fully appreciated that the above disclosure provides significant advancements to the art of constructing a swellable packer assembly. One example is described above in which a ring-shaped plate 38 is embedded in a swellable seal material 32 and placed on a base pipe 28, thereby increasing a differential pressure holding capability of the packer assembly 12. Another example is described above in which the ring-shaped plate 38 is secured to the base pipe 28, and then the swellable seal material 32 is molded onto the base pipe.

A packer assembly 12 for use with a subterranean well is provided to the art by the above disclosure. In one example, the packer assembly 12 includes a base pipe 28, at least one ring-shaped reinforcement plate 38 which encircles the base pipe 28, and at least one swellable seal material 32 which longitudinally straddles the reinforcement plate 38 on the base pipe 28.

The plate 38 may have a radial thickness RT which is greater than a longitudinal thickness LT of the plate 38. The plate 38 can be embedded in the seal material 32.

The plate 38 in some examples can be secured to the base pipe 28, thereby preventing longitudinal displacement of the plate 38 relative to the base pipe 28. In other examples, longitudinal displacement of the plate 38 relative to the base pipe 28 is permitted.

The seal material 32 may extend through at least one opening 40 in the plate 38. The seal material 32 may be bonded through the opening 40 in the plate 38.

A first seal element 22 can be bonded to a second seal element 22 via at least one opening 40 in the plate 38. The seal material 32 may be molded through at least one opening 40 in the plate 38.

The seal material 32 may adhere to the plate 38. The plate 38 can be flat, and/or can comprise a metal.

A method of constructing a packer assembly 12 is also described above. In one example, the method can comprise: securing at least one ring-shaped reinforcement plate 38 to a base pipe 28, the plate 38 encircling the base pipe 28, and then positioning at least one swellable seal material 32 on the base pipe 28, the swellable seal material 32 straddling the reinforcement plate 38.

The positioning step can also include molding the seal material 32 onto the base pipe 28, molding the seal material 32 longitudinally between two reinforcement plates 38, embedding the plate 38 in the seal material 32, extending the seal material 32 through at least one opening 40 in the plate 38, bonding the seal material 32 through at least one opening 40 in the plate 38, bonding a first seal element 22 to a second seal element 22 via at least one opening 40 in the plate 38, molding the seal material 32 through at least one opening 40 in the plate 38, and/or adhering the seal material 32 to the plate 38.

The securing step can include preventing longitudinal displacement of the plate 38 relative to the base pipe 28.

Another method of constructing a packer assembly 12 can comprise: securing at least one ring-shaped reinforcement plate 38 to at least one swellable seal material 32, and then positioning the plate 38 and the swellable seal material 32 on a base pipe 28.

The securing step may include the swellable seal material 32 straddling the reinforcement plate 38, embedding the plate 38 in the seal material 32, extending the seal material 32 through at least one opening 40 in the plate 38, bonding the seal material 32 through at least one opening 40 in the plate 38, bonding a first seal element 22 to a second seal element 22 via at least one opening 40 in the plate 38, molding the seal material 32 through at least one opening 40 in the plate 38, and/or adhering the seal material 32 to the plate 38.

The positioning step can include the plate 38 encircling the base pipe 28, and/or molding the seal material 32 longitudinally between two reinforcement plates 38. Longitudinal displacement of the plate 38 relative to the base pipe 28 may be permitted after the positioning step.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) may be used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer assembly for use with a subterranean well, the packer assembly comprising:

a base pipe;

at least one ring-shaped reinforcement plate which encircles the base pipe, wherein the ring-shaped reinforcement plate includes a radial thickness and a longitudinal thickness, wherein the radial thickness is greater than the longitudinal thickness; and at least one swellable seal material which longitudinally straddles the reinforcement plate on the base pipe, wherein the seal material extends through at least one opening in the plate, wherein an outer diameter of the reinforcement plate is the same as an outer diameter of the swellable seal material.

* * * * *